US006988504B1

(12) United States Patent
Goldwitz

(10) Patent No.: US 6,988,504 B1
(45) Date of Patent: Jan. 24, 2006

(54) UMBRELLA ASSEMBLY

(75) Inventor: Brian L. Goldwitz, Orange, CT (US)

(73) Assignee: Tracy Goldwitz, Orange, CT (US)

( * ) Notice: Subject to any disclaimer, the term of this patent is extended or adjusted under 35 U.S.C. 154(b) by 289 days.

(21) Appl. No.: 10/048,895

(22) PCT Filed: Aug. 14, 2000

(86) PCT No.: PCT/US00/40639

§ 371 (c)(1),
(2), (4) Date: May 2, 2002

(87) PCT Pub. No.: WO01/12009

PCT Pub. Date: Feb. 22, 2001

Related U.S. Application Data

(60) Provisional application No. 60/158,580, filed on Oct. 7, 1999, provisional application No. 60/149,026, filed on Aug. 13, 1999.

(51) Int. Cl.
*A45B 11/00* (2006.01)

(52) U.S. Cl. ..... 135/20.1; 135/20.3; 135/98; 135/21; 248/288.51; 403/93; 403/103

(58) Field of Classification Search ..... 135/15.1, 135/20.1, 20.3, 21, 98; 248/328, 320, 332, 248/125.2, 288.31, 288.51; 403/102–103, 403/84, 93
See application file for complete search history.

(56) References Cited

U.S. PATENT DOCUMENTS

| | | | | |
|---|---|---|---|---|
| 169,599 | A | 11/1875 | Tibbals | |
| 281,675 | A | 7/1883 | Eichling et al. | |
| 332,917 | A | 12/1885 | Markam | |
| 508,418 | A | 11/1893 | Heaney | |
| 552,115 | A | 12/1895 | Frye | |
| 565,619 | A * | 8/1896 | Haynes | 135/21 |
| 2,658,225 | A | 11/1953 | Bascom | |
| 2,767,723 | A | 10/1956 | Sears, Jr. | |
| 4,606,366 | A | 8/1986 | Collet | |
| 5,611,364 | A | 3/1997 | Woods et al. | |
| 5,678,585 | A | 10/1997 | May | |
| 5,735,302 | A | 4/1998 | Saliva | |
| 5,785,069 | A | 7/1998 | Glatz | |
| D398,443 | S | 9/1998 | Bolle | |

(Continued)

FOREIGN PATENT DOCUMENTS

| | | | |
|---|---|---|---|
| DE | 3820573 | * | 8/1989 |

(Continued)

*Primary Examiner*—Winnie Yip
(74) *Attorney, Agent, or Firm*—Edwards & Angell, LLP; George N. Chaclas, Esq.

(57) ABSTRACT

An umbrella assembly comprising a base, a pole mounted on the base extending upwardly and outwardly from the base, a carriage slidably mounted on the pole, and an umbrella frame including an adapter releasably engagable with the carriage. A handle is rotatably mounted on the pole, and a cable is coupled at one end to the handle and coupled at another end to the umbrella frame such that by rotating the handle, the cable is retracted and the umbrella is opened, and by rotating the handle in the opposite direction, the cable is released, the umbrella is collapsed, and the carriage is slidable along the pole. The cable is coupled to the adapter such that the adapter may be releasably secured to the umbrella frame to allow the umbrella frame to be tilted and secured in an inclined position.

25 Claims, 12 Drawing Sheets

U.S. PATENT DOCUMENTS

| | | | | | |
|---|---|---|---|---|---|
| 5,845,665 | A | * | 12/1998 | Koehn | 135/20.1 |
| 5,937,881 | A | | 8/1999 | Villa | |
| 5,937,882 | A | | 8/1999 | Harbaugh | |
| 5,960,806 | A | | 10/1999 | Steiner | |
| 6,152,156 | A | * | 11/2000 | Tung | 135/21 |
| D434,556 | S | | 12/2000 | Lin | |
| 6,220,261 | B1 | | 4/2001 | Glatz | |
| 6,401,739 | B1 | | 6/2002 | Bright et al. | |
| 6,662,815 | B2 | * | 12/2003 | Tung | 135/20.1 |

FOREIGN PATENT DOCUMENTS

| | | | |
|---|---|---|---|
| EP | 334821 | | 9/1989 |
| FR | 2752512 | * | 9/1998 |

* cited by examiner

UMBRELLA ASSEMBLY

RELATED APPLICATIONS

This application claims the benefit of U.S. Provisional Patent Applications Ser. No. 60/149,026 filed Aug. 13, 1999, and Ser. No. 60/158,580 filed Oct. 7, 1999, both of Brian L. Goldwitz, the disclosures of which are herein incorporated by reference.

FIELD OF THE INVENTION

The present invention relates to umbrella assemblies, and more particularly to foldable umbrellas that may be readily opened and readily collapsed.

BACKGROUND INFORMATION

Foldable umbrellas are known in the prior art. For example, U.S. Pat. No. 5,785,069 to Glatz shows a standing umbrella with a mast, a movable carrier beam, and a connecting strut linking the mast and the carrier bean. A drive mechanism folds the carrier beam relative to the mast, and opens and closes the umbrella. Similarly, U.S. Pat. No. 5,678,585 to May shows an umbrella with a mast, an elongated boom, and a fitting located on the mast that slidably receives the boom. A foldable canopy forming an umbrella is connected to one end of the elongated boom.

One drawback associated with these and other prior art umbrellas is the complexity of the mast and associated supporting frame members and connectors. Having more than one supporting frame member requires correspondingly complex drive mechanisms and also increases the likelihood that an individual component will fail thereby rendering the umbrella assembly inoperable. Moreover, relatively complex supporting frame structures and drive mechanisms increase manufacturing cost, and ultimately increase consumer cost.

Accordingly, it is an object of the present invention to overcome these and other drawbacks and disadvantages of the prior art.

SUMMARY OF THE INVENTION

The present invention is directed to an umbrella assembly comprising a base, a pole, and an umbrella frame. The pole is mounted on the base and extends upwardly and laterally from the base. A handle is mounted on the lower portion of the pole, and a cable extending through the pole is coupled to the umbrella frame and to the handle. A carriage is slidably attached to the pole such that it can be moved along the pole from the upper end of the pole to the location of the handle.

The umbrella frame includes an adapter that is connected to the carriage such that the umbrella frame is movable with the carriage along the pole. When the handle is rotated in one direction, for example clockwise, the cable is retracted, and the adapter is releasably locked to the umbrella frame and the carriage. Upon further rotating the handle in the same direction, the umbrella frame is extended to an open condition forming an umbrella located at the upper end of the pole.

Alternatively, when the handle is rotated in the other direction, for example counter-clockwise, the cable is released and the umbrella frame is retracted to a closed condition at the upper end of the pole. Upon further rotating the handle in this direction, the adapter is unlocked from the umbrella frame and the carriage to thereby permit the umbrella frame to pivotally rotate in relation to the adapter. At this point, the cable can be retracted to thereby releasably lock the umbrella frame to the adapter in an inclined or tilted position, or releasably lock the adapter to the carriage thereby locking the umbrella frame in an inclined or tilted position. The umbrella can be opened by further retracting the cable. In contrast, the cable can be further released by turning the handle as previously described and the carriage and umbrella frame will correspondingly slide along the pole to any position between the upper end of the pole and the location at which the handle is mounted on the pole.

One advantage of the present invention is that the supporting frame for the umbrella assembly comprises one upright member instead of a mast and boom assembly. Accordingly, a less complicated drive mechanism can be employed to open and close the umbrella frame, as well as to move the umbrella frame relative to the supporting frame. As a result, the likelihood that an individual component will fail and render the umbrella assembly inoperable is substantially reduced. Moreover, a relatively simple supporting frame structure and drive mechanism can correspondingly decrease the overall manufacturing and consumer cost.

Other objects and advantages of the present invention will become apparent in view of the following detailed description of the preferred embodiments and accompanying drawings.

BRIEF DESCRIPTION OF THE DRAWINGS

FIG. 8A illustrates the locked condition and FIG. 8B illustrates the unlocked condition.

DETAILED DESCRIPTION OF THE PREFERRED EMBODIMENTS

Figure 1:
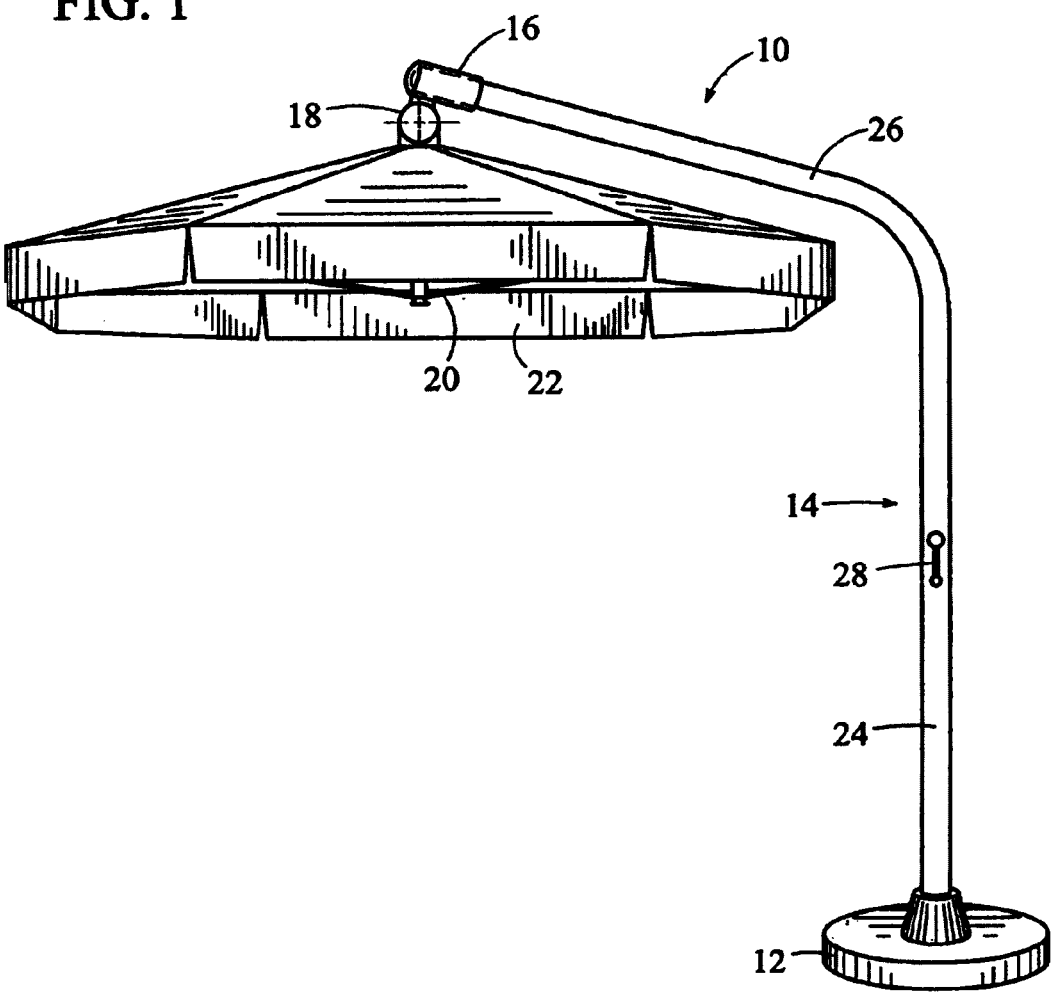
FIG. 1 is a side perspective view of an umbrella assembly of the present invention, showing a pole extending upwardly and laterally from the base.

As shown in FIG. 1, an umbrella assembly 10 of the present invention comprises a base 12, a pole 14 mounted on the base 12, a carriage 16 slidably mounted on the pole 14, an adapter 18 coupled to the carriage 16, an umbrella frame 20 coupled to the adapter 18, and a cover 22 attached to the umbrella frame 20. The pole 14 further includes a first or lower portion 24 extending upwardly from the base 12, and a second or upper portion 26 extending laterally outwardly away from the base. A handle 28 is rotatably mounted on the pole 14 in a known manner. The umbrella assembly 10 is shown in an open condition wherein the umbrella frame 20 is held in a fully extended position to thereby place the cover 22 in a conventional umbrella position.

It will be appreciated that the base 12 and pole 14 each may include a variety of configurations depending on the particular application. For example, the base 12 may be mounted to a wall, door or other structure (none of which are shown) but is preferably set on a ground surface as illustrated. Also, the pole 14 may extend in various directions at various angles from the base depending upon the application and location of a table, item or person to be covered by the umbrella assembly. Further, the pole 14 can also include a plurality of different cross-sectional configurations such as, for example, cylindrical, square, rectangular, and hexagonal, and is preferably a hollow or tubular configuration. As described in more detail below, this configuration advantageously houses and protects a means for opening and closing the umbrella.

Figure 2:
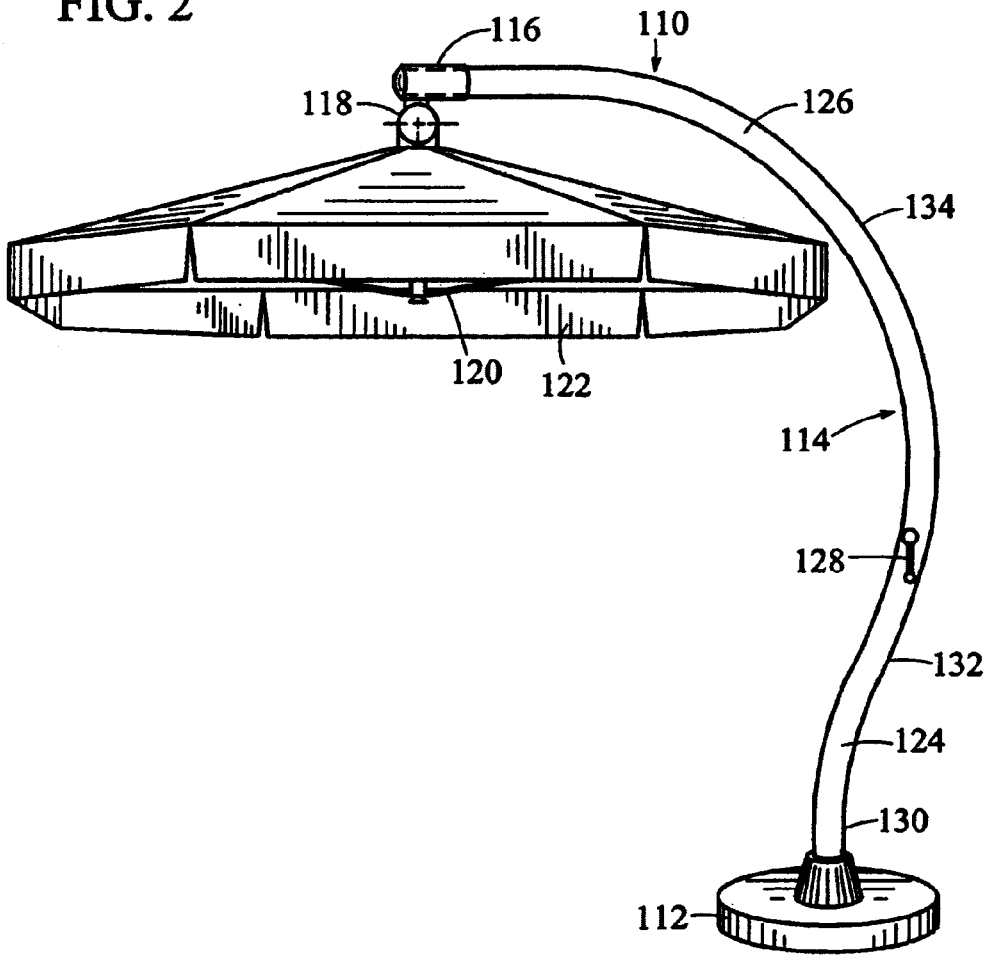
FIG. 2 is a side perspective view of another embodiment of an umbrella assembly of the present invention, showing a curved pole extending upwardly, rearwardly, and then forwardly from the base.

FIG. 2 shows another embodiment of an umbrella assembly in accordance with the present invention generally at 110 which may be similar to the embodiment discussed above and wherein like elements are indicated by like reference numerals preceded by the numeral 1. As discussed in further detail below, a pole 114 similar to pole 14 discussed above has an arcuate outer configuration as opposed to a generally linear configuration shown in FIG. 1. It will be appreciated that either configuration may be more advantageous than the other depending upon the application.

In the embodiment of FIG. 2, the umbrella assembly 110 comprises a base 112, a pole 114, a carriage 116, an adapter 118, an umbrella frame 120, a cover 122, and a handle 128. The pole 114 includes a first or lower portion 124 and a second or upper portion 126. The lower portion 124 further includes a first length 130 immediately adjacent to the base 112 extending upwardly, a second length 132 extending upwardly from the first length 130 and curved rearwardly in relation to the umbrella frame 120, and a third length 134 extending upwardly from the second length 132 and curved inwardly in relation to the umbrella frame 120.

It will be understood that the following description of further details of the embodiment of FIG. 2 is equally applicable, e.g., to the embodiment of FIG. 1 and other configurations of the pole and thus is not intended to be limiting in any manner.

Figure 3:
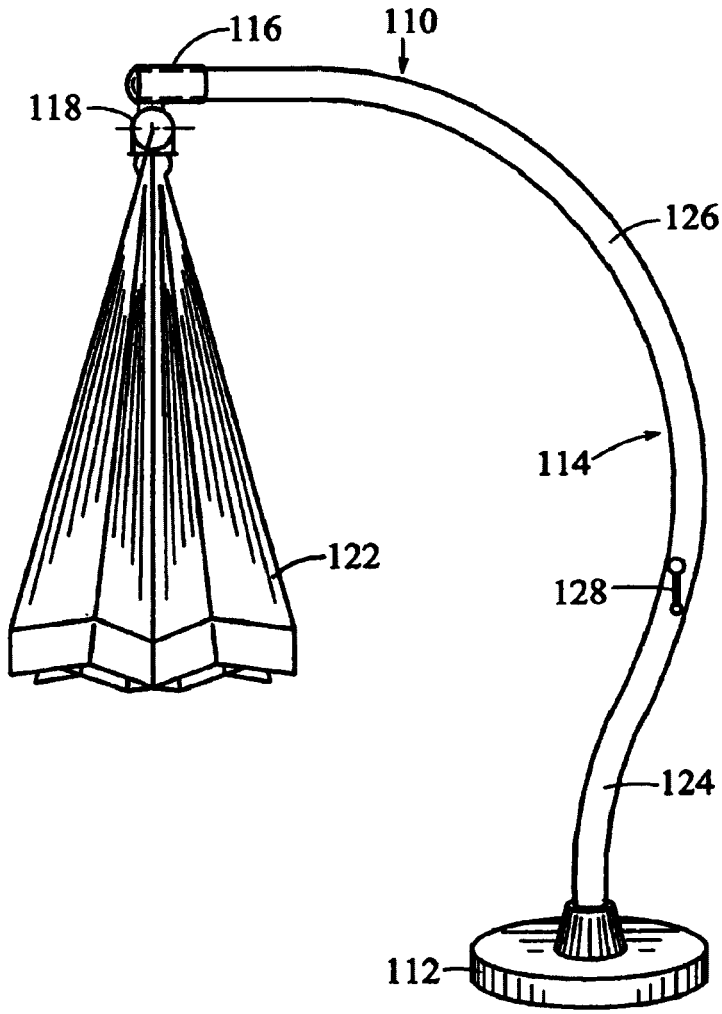
FIGS. 3–5 are sequential perspective views showing the umbrella assembly of FIG. 2 and illustrating the collapsing of the umbrella assembly and movement of the umbrella carrier along the pole.
Figure 4:
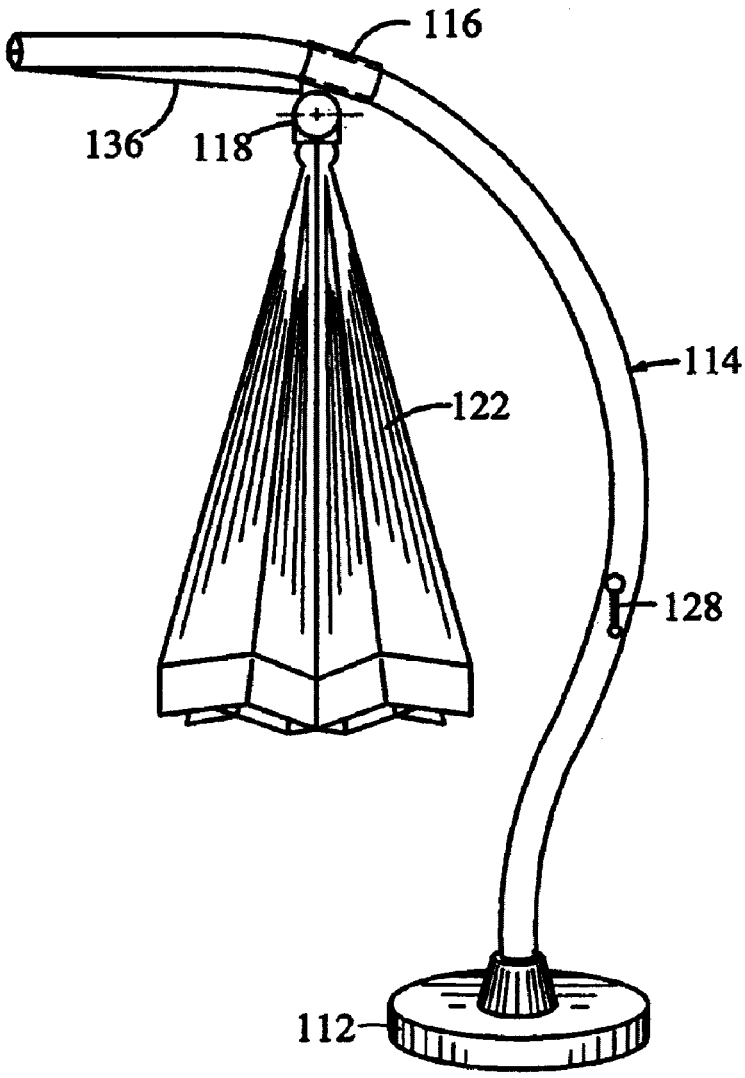
Figure 5:
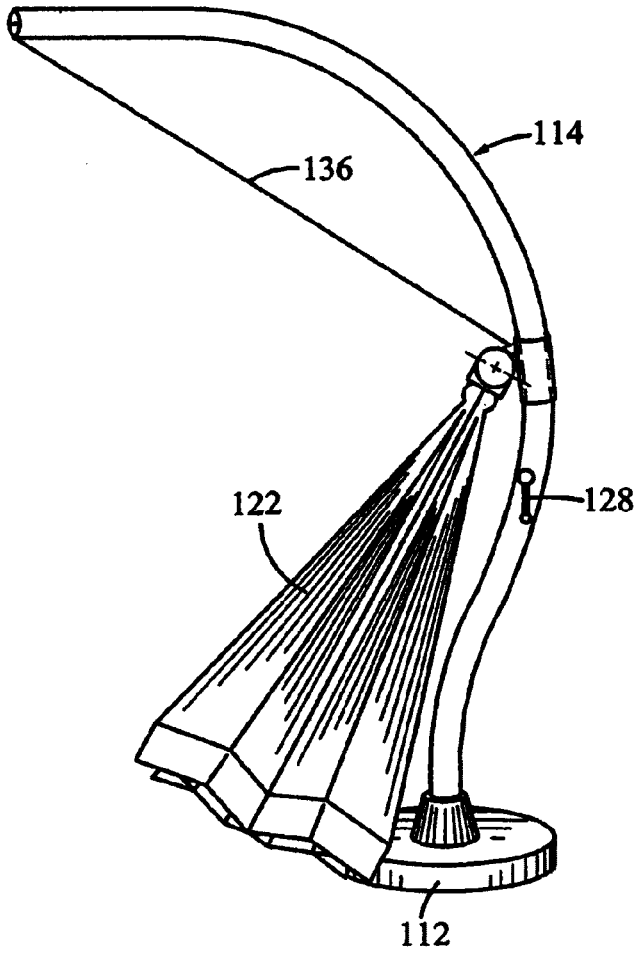

Referring now to FIGS. 3 through 5, the umbrella assembly 110 is illustrated in the sequences of collapsing the umbrella frame 120 and moving the carriage 116 along the pole 114 to a storage condition that may be accomplished via rotation of the handle 128. In particular, a cable 136 is coupled at one end to the adapter 118, which is in turn connected to the umbrella frame 120. The cable 136 is coupled at another end to the handle 128 mounted to the lower portion 124 of the pole 114. By rotating the handle 128 in a first direction, for example clockwise, the cable 136 is tensioned or retracted, and in turn the umbrella frame 120 is extended into an open condition spaced laterally from the base 112 on the upper portion 126 of the pole 114 as shown in FIG. 2.

When the handle 128 is rotated in a second direction, for example counter-clockwise, the cable 136 is released, and in turn the umbrella frame 120 is collapsed into a closed condition spaced laterally in relation to the base 112 on the upper portion 126 of the pole 114 as shown in FIG. 3. By further rotating the handle 128 in the second direction to thereby further release the cable, the carriage 116 slidably moves laterally toward to the base 112 along the upper portion 126 of the pole 114, to a lowermost point approximately adjacent to the handle 128 as shown in FIG. 5.

Figure 6:
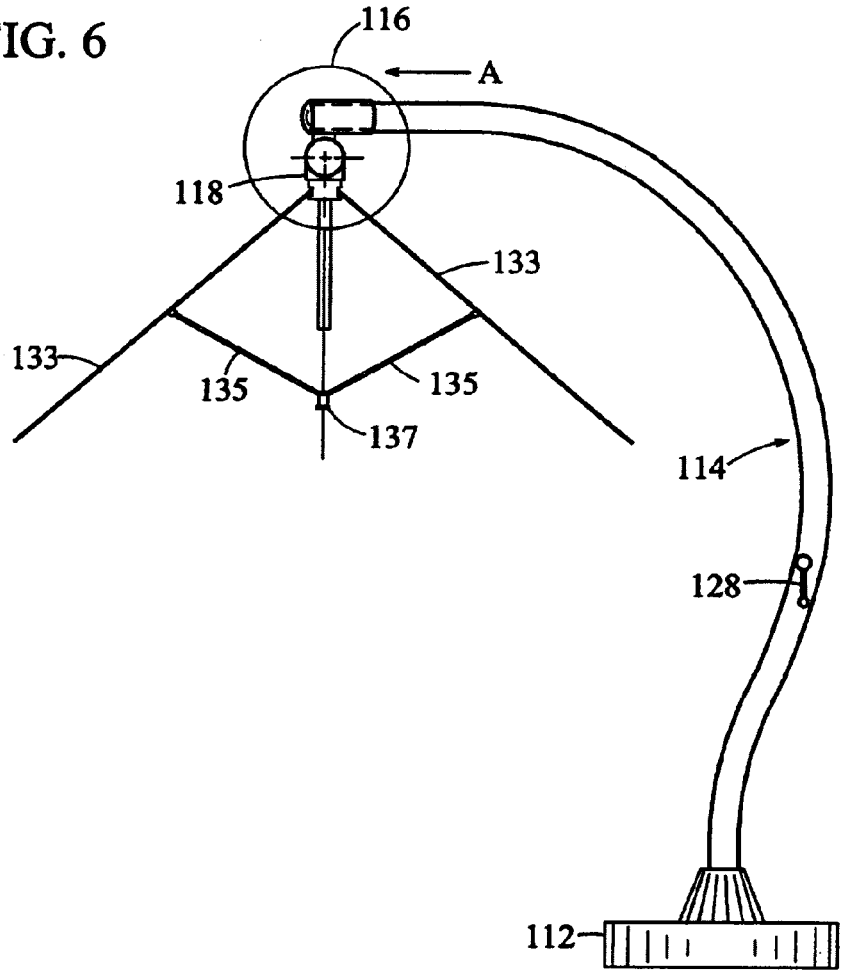
FIG. 6 is a side elevational and partial schematic view of the umbrella assembly of FIG. 2, with the umbrella covering removed to show the umbrella frame.
Figure 7:
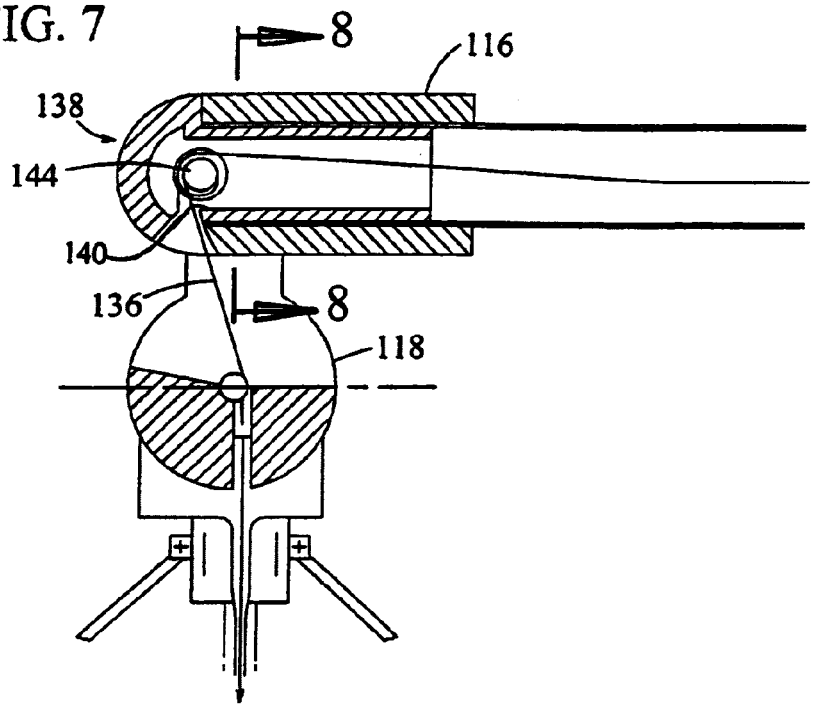
FIG. 7 is an enlarged side elevational view, partly in section, of a portion of the umbrella assembly labeled A in FIG. 6, showing the carriage connected to the pole, and the adapter connected between the carriage and the umbrella frame.

As illustrated in FIG. 6, the umbrella frame 120 comprises hinged fabric support bars 133 and hinged cross bars 135 which cooperate to open and close the umbrella frame 120 as discussed above. As previously described and shown in more detail in FIG. 6, the cable 136 terminates at a hub 137 of the umbrella frame 120 and is coupled to the adapter 118, the carriage 116, and the handle 128. When the cable 136 is tensioned or retracted, the umbrella frame 120 is pulled upwardly to thereby extend the umbrella frame 120 into an open condition. When the cable 136 is released, the umbrella frame 120 is pulled downwardly by gravity to thereby collapse the umbrella frame 120 into a closed condition.

As shown in FIG. 6 and in further detail in FIGS. 7, 8A, 8B and 8C an endcap 138 is mounted to upper end 140 of the pole 114. The endcap 138 functions to prevent the carriage 116 from moving off the upper end 140 of the pole 114. The endcap 138 comprises a rotatable pulley 144, or like cable guide, to guide cable 136 through the upper end 140 of the pole 114 and into the adapter 118.

Figure 8A:
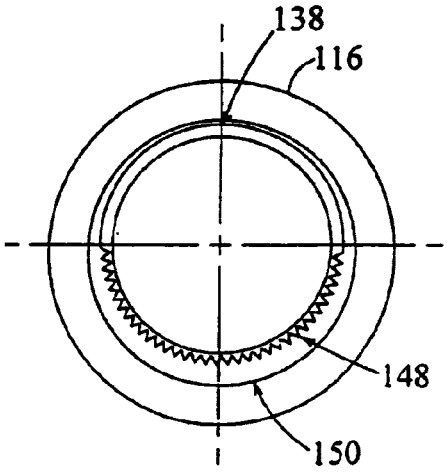
FIGS. 8A and 8B are sectional sequential views taken along line 8—8 of FIG. 7, showing a means for releasably locking the adapter to the carriage of the umbrella assembly.
Figure 8B:
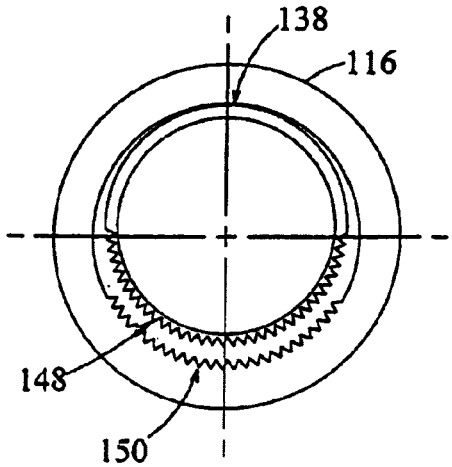
Figure 8C:
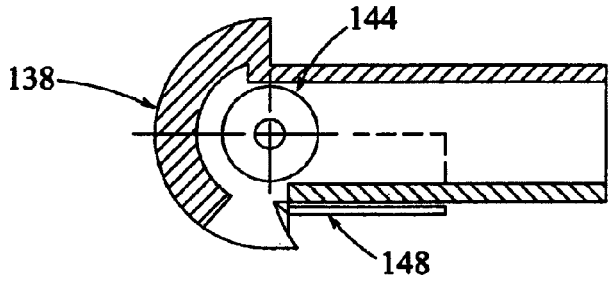
FIG. 8C is a side sectional view of an endcap that may be inserted into the upper end of the pole of the umbrella assembly.

Referring now to FIGS. 8A, 8B and 8C the end 146 of endcap 138 includes an engaging means, for example, teeth 148. Similarly, the carriage 116 defines a corresponding engaging means, e.g., teeth, 150 for releasably locking with the teeth 148 of the endcap 138 to prevent relative rotation of the carriage with respect to the endcap.

The cable 136 is coupled to the umbrella frame 120 such that the teeth 150 of the carriage are urged into engagement with teeth 148 of the endcap 138 as shown in FIG. 8A when the cable 136 is tensioned. In particular, the tension on the cable 136 forces the carriage 116 in the opposite direction or upwardly. It will be understood that upon releasing tension in cable 136 the teeth 150 of the carriage 116 and the teeth 148 of the endcap 138 disengage, as shown in FIG. 8B.

Figure 9:
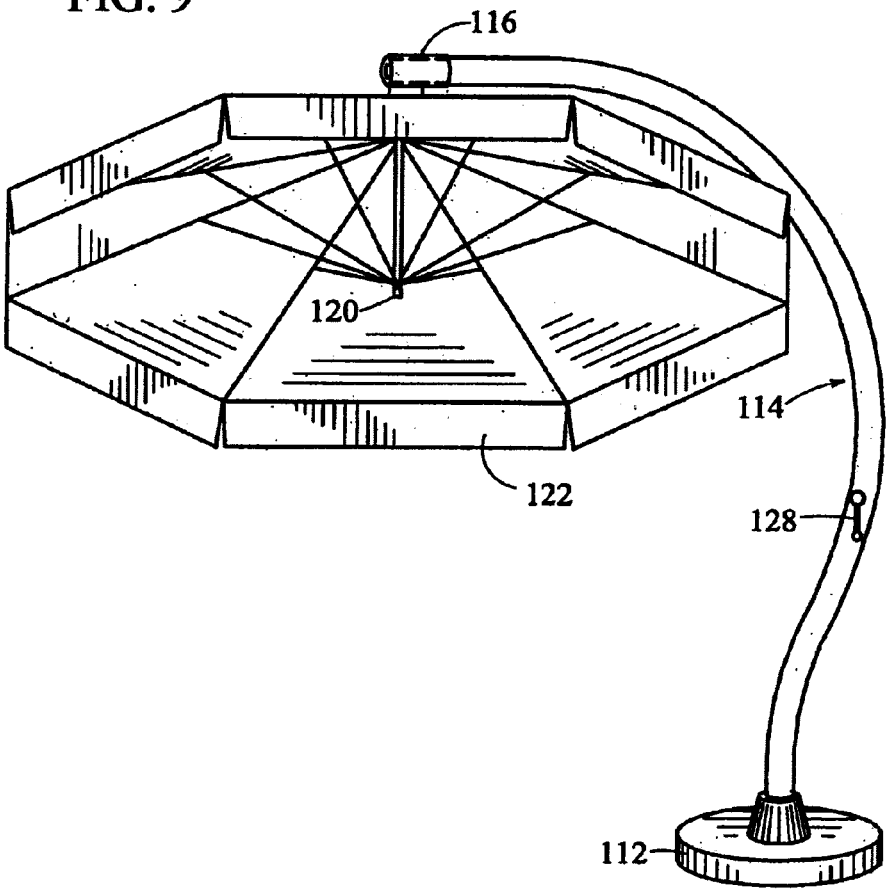
FIG. 9 is a side perspective view of the umbrella assembly of FIG. 2 with the umbrella shown in an open condition and tilted to one side.

When teeth 148 and 150 are disengaged, the umbrella frame may be tilted to an inclined position relative to a horizontal plane, in right and left directions in relation to the pole 114 as shown in FIG. 9. Thereafter, the cable 136 can be tensioned to engage teeth 148 and also, in turn, the endcap 138 and the carriage 116 to thereby secure the umbrella frame 120 in the inclined position.

Figure 10A:
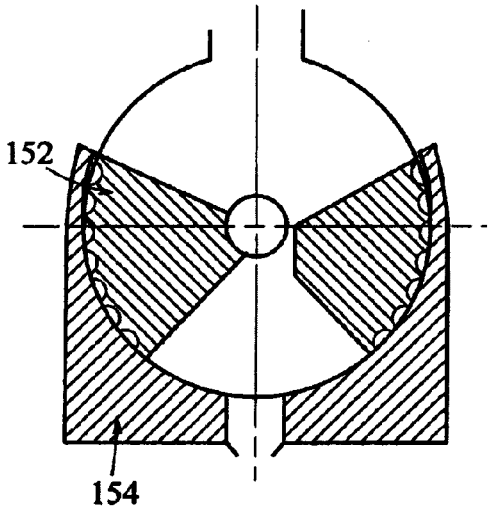
FIGS. 10A and 10B are sectional views showing the adapter in the locked and the unlocked conditions, respectively.
Figure 10B:
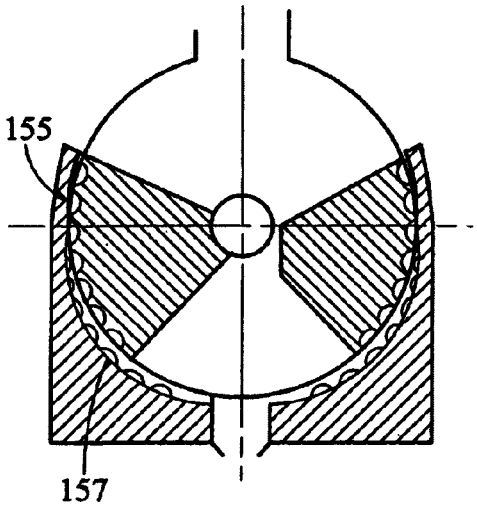
Figure 10:
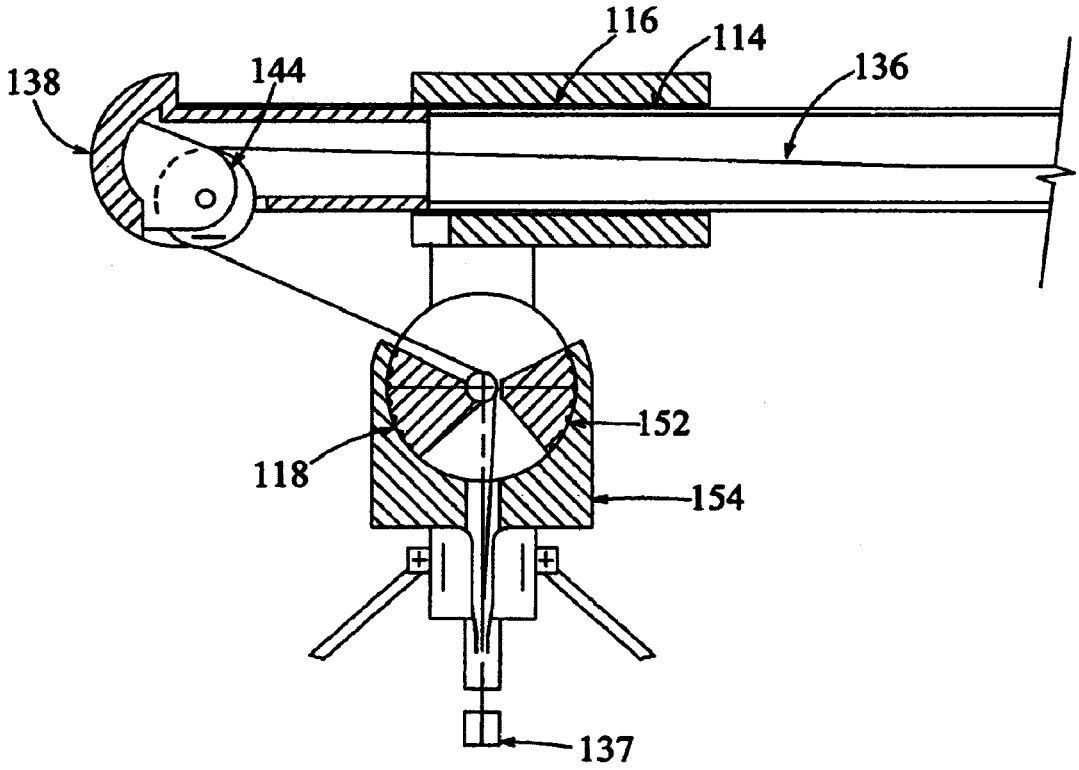
FIG. 10 is an enlarged side elevational view, partly in section, of a portion of the umbrella assembly of FIG. 6, showing the carriage at a point on the pole some distance away from the endcap, and the adapter connected between the carriage and the umbrella frame.

As shown in FIGS. 10, 10A and 10B, the adapter 118 comprises a ball 152 and a socket 154. As shown in detail in FIGS. 10A and 10B, the ball 152 and socket 154 each include corresponding engagement means, for example corresponding depressed and raised surfaces, e.g. depressed surfaces 155 and raised surfaces 157 best seen in FIG. 10B, which together function to releasably lock the ball 152 and socket 154 in a selected position. The cable 136 is coupled to the adapter 118 via a pulley 115 so that the ball 152 and socket 154 are responsive to tensioning of the cable 136 to, in turn, releasably lock the ball 152 and socket 154 together, as shown in FIG. 10A. The ball 152 and socket 154 may be unlocked via untensioning of cable 136, thereby releasing the force on pulley 115, as shown on FIG. 10B.

Figure 11:
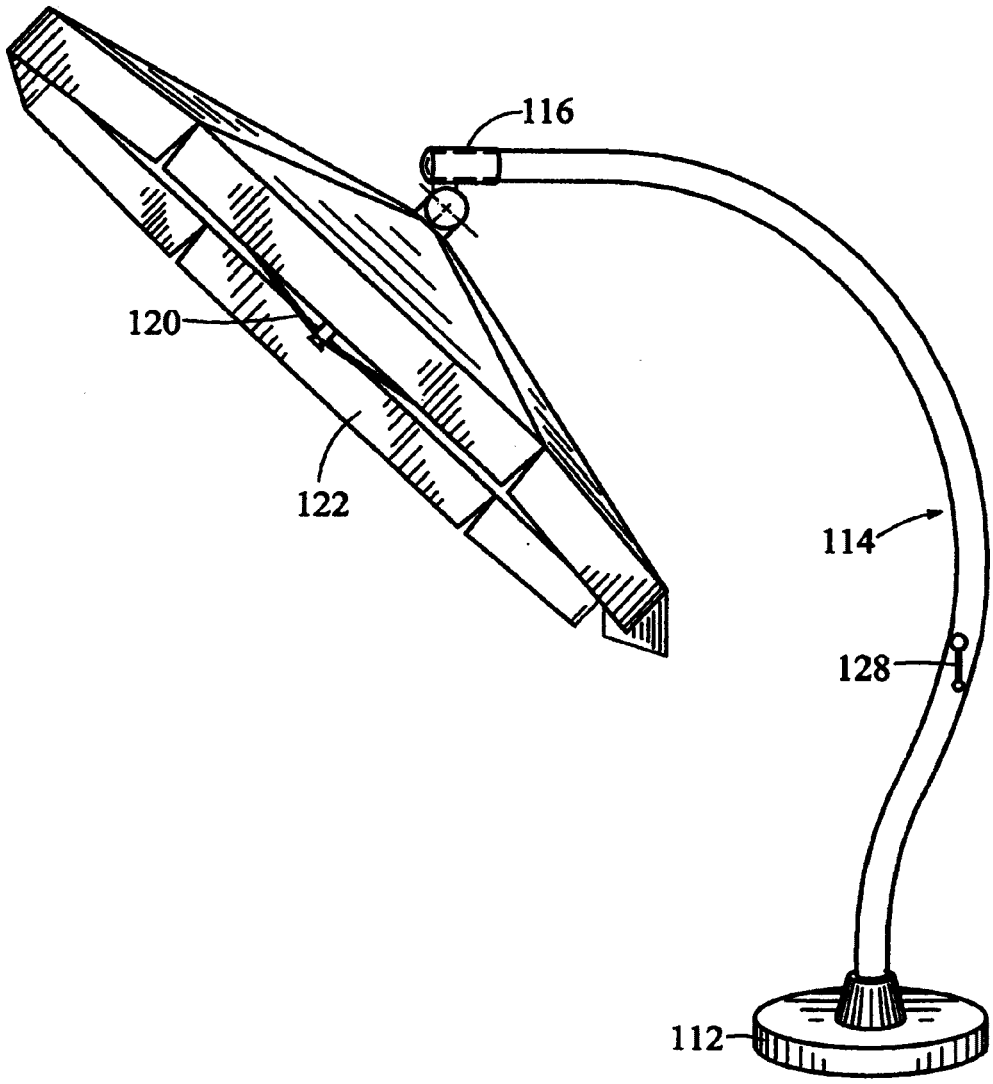
FIG. 11 is a side perspective view of the umbrella assembly of FIG. 2, with the umbrella shown in an open condition and at an inclined angle.

The releasably lockable engagable means 156 and 158 allow the umbrella frame to be tilted in an inclined position relative to a horizontal plane, in an upward and downward directions in relation to the pole 114 as shown in FIG. 11. When the cable 136 is released such that the ball 152 and socket 154 are disengaged from one another, the umbrella frame 120 can be tilted into an inclined position. Thereafter, the cable 136 can be tensioned to couple the ball 152 and socket 154 because of the associated force on pulley 155 to thereby secure the umbrella frame 120 in the inclined position.

Figure 12B:
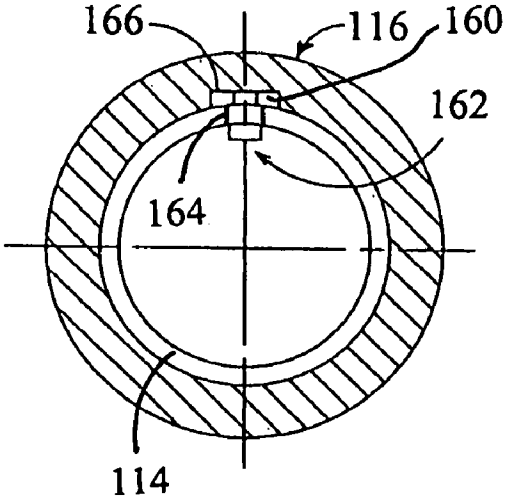
FIGS. 12A and 12B are cross sectional views showing the carriage slidably connected to the pole of the umbrella assembly.
Figure 12A:
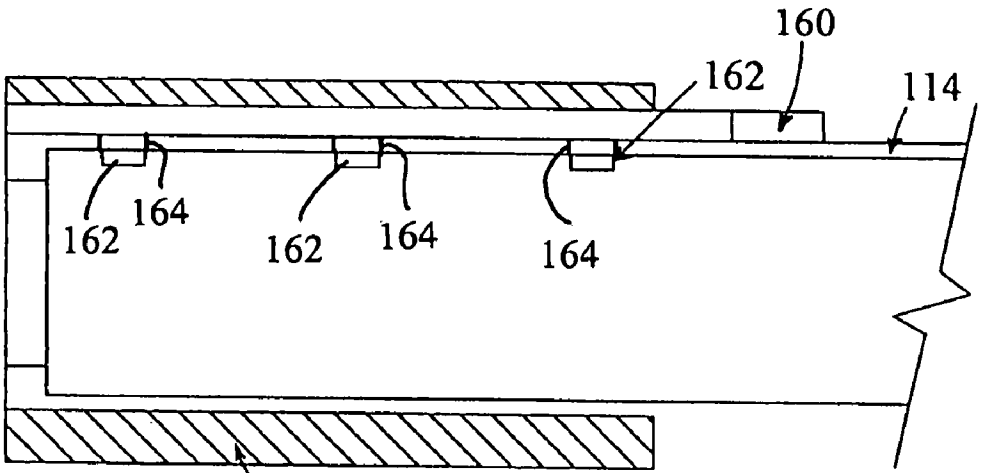
Figure 12C:
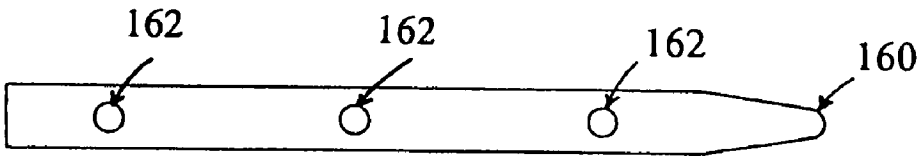
FIG. 12C is a plan view of a track for engaging the carriage.

As shown in FIGS. 12A, 12B and 12C, the pole 114 comprises a track 160 mounted thereon for slidably engaging the carriage 116. The track 160 includes protuberances 162 frictionally received within corresponding apertures 164 in the pole 114. The track 160 can be mounted to the pole 114 by any one of numerous means known such as employing an adhesive or a fastening means such as a rivet. The carriage 116 includes an elongated slot 166 for slidably engaging track 160 as shown in FIG. 12B. As described above, by rotating the handle 128 in the direction corresponding to releasing the cable 136, the carriage 116 moves laterally along pole 114, and slidably engages track 160.

As may be recognized by those skilled in the pertinent art based on the teachings herein, any of the releasably engagable means or the cable retracting and releasing means employed in an umbrella assembly of the present invention may take any of numerous different shapes, configurations, and/or types of such means that are currently or later become known for performing the functions of the means described herein. For example, rather than employing engagable teeth or raised and depressed surfaces to couple the carriage and the endcap or the adapter ball and socket, any one of numerous detachable fasteners such as a locking pin or clevis pin can be used. Similarly, rather than selecting a handle to retract and release the cable, a crank, knob, or wheel can be used.

One advantage to the umbrella assembly of the present invention is that after the umbrella frame is collapsed, it can easily be moved away from the upper end of the pole without employing any additional mechanical means. Additionally, there are no lateral or upright frame members that have to be moved in order to move the umbrella frame, and therefore less space is required to collapse and move the umbrella frame of the present invention.

As may be recognized by those skilled in the pertinent art based on the teachings herein, numerous other changes and modifications may be made to the above-described and other embodiments of the present invention without departing from its scope as defined in the appended claims. Accordingly, this detailed description of preferred embodiments is to be taken in an illustrative, as opposed to a limiting sense.

What is claimed is:

1. An umbrella assembly, comprising a base;

a pole mounted on the base including a lower portion extending upwardly from the base, and an upper portion extending laterally from the base, a carriage slidably mounted on the pole;

an umbrella frame including an adapter coupled to the carriage;

a handle rotatably mounted on the pole; and a cable coupled at one end to the handle and coupled at another end to the umbrella frame;

wherein the handle is (i) rotatable in a first direction to thereby retract the cable and in turn move the carriage to a location spaced laterally from the base on the upper portion of the pole and, in turn, extend the umbrella frame into an open condition, (ii) rotatable in a second direction to release the cable and in turn collapse the umbrella frame into a closed condition spaced laterally outwardly in relation to the base on the upper portion of the pole, and (iii) further rotatable in the second direction to slidably move the carriage laterally inwardly in relation to the base along the upper portion of the pole.

2. An umbrella assembly as defined in claim 1, wherein the cable is coupled to the adapter and the adapter is configured to be responsive to untensioning of the cable to allow the umbrella frame to be tilted in an inclined position relative to a horizontal plane, and responsive to tensioning of the cable to thereby secure the umbrella frame in the inclined position.

3. An umbrella assembly as defined in claim 1, further comprising a cover detachably fastened to the umbrella frame.

4. An umbrella assembly as defined in claim 1, wherein the carriage is slidably mounted on the pole and slidable over the pole.

5. An umbrella assembly as defined in claim 1, wherein the carriage is slidably mounted on the pole and slidable within the pole.

6. An umbrella assembly as defined in claim 1, wherein the handle is mounted on the lower portion of the pole.

7. An umbrella assembly as defined in claim 1, wherein the pole defines a tubular configuration.

8. An umbrella assembly as defined in claim 7, where in the pole defines a cylindrical cross-sectional configuration.

9. An umbrella assembly as defined in claim 1, wherein the pole extends upwardly and laterally outwardly from the base, and laterally rearwardly from the base in relation to the umbrella frame.

10. An umbrella assembly as defined in claim 9, wherein the lower portion of the pole further includes a first end immediately adjacent to the base extending upwardly from the base, and a second end extending rearwardly from the base in relation to the umbrella frame.

11. An umbrella assembly as defined in claim 1, wherein the pole includes arcuate and straight sections.

12. An umbrella assembly as defined in claim 1, further comprising an endcap wherein a first end of the endcap is slidably mounted in a first end of the pole opposite to a second end of the pole mounted on the base, and a second end of the endcap is larger in diameter than the pole to thereby prevent the carriage from moving off the end of the pole in which the endcap is mounted.

13. An umbrella assembly as defined in claim 12, wherein the carriage and endcap arc configured to be responsive to untensioning of the cable to disengage the carriage from the endcap thereby allowing the umbrella frame to be moved to an inclined position relative to a horizontal plane, and responsive to tensioning of the cable to couple the endcap and the carriage together and thereby secure the umbrella frame in the inclined position.

14. An umbrella assembly as defined in claim 1, further comprising a track mounted on the pole and an elongated slot formed in the carriage for slidably receiving the track.

15. An umbrella assembly, comprising:

a base;

a pole extending from the base and including a first portion and a second portion extending in a generally radial direction from the longitudinal direction of the first portion of the pole, a carriage slidably disposed on the pole;

an umbrella frame interconnected with the carriage;

a handle rotatably mounted on the pole; and a cable coupled at one end to the handle and coupled at another end to the umbrella frame;

wherein the handle is (i) rotatable in a first direction to thereby extend the umbrella frame into an open condition spaced laterally from the first portion of the pole and being located on the second portion of the pole, (ii) and rotatable in a second direction to thereby collapse the umbrella frame into a closed condition and (iii) move the carriage toward the first portion along the second portion of the pole.

16. An umbrella assembly, comprising:

a base:

a pole extending from the base and having a first end disposed proximal to the base and a second end disposed distal from the base;

a carriage movably disposed on the pole;

an umbrella frame supporting a cover and both the umbrella frame and cover being movable with the carriage;

means for actuating the carriage and the umbrella frame for (i) moving umbrella frame to the second end of the pole and extending the umbrella frame into an open condition, wherein the means for actuating is configured to allow the umbrella frame to be tilted in an inclined position relative to a horizontal plane to thereby secure the umbrella frame in the inclined position, and (ii) collapsing the umbrella frame into a closed condition and moving the carriage directly along the pole toward the first end of the pole.

17. An umbrella assembly as defined in claim 16, wherein the actuation means comprises:

a handle rotatably mounted on the pole; and a cable coupled at one end to the handle and coupled at another end to the umbrella frame.

18. And umbrella assembly as defined in claim 17, further comprising an adapter coupled to the carriage, wherein the adapter is configured to be responsive to tensioning of the cable to secure the umbrella frame at a predetermined orientation and responsive to untensioning of the cable to allow the umbrella frame to be movable to another orientation.

19. An umbrella assembly as defined in claim 17, further comprising an endcap disposed at the second end of the pole and wherein the carriage and endcap are configured to be responsive to tensioning of the cable to secure the carriage at a predetermined orientation and responsive to untensioning of the cable to allow movement of the carriage to another orientation.

20. An umbrella assembly comprising:

a base;

a pole mounted on the base;

a carriage slidably mounted on the pole;

an umbrella frame coupled to the carriage;

a handle rotatably mounted on the pole; and a cable coupled at one end to the handle and coupled at another end to the umbrella frame; and an endcap mounted in a first end of the pole opposite to a second end of the pole mounted on the base, the endcap having means for selectively engaging the carriage for preventing relative rotation of the umbrella frame, and wherein the handle is (i) rotatable in a first direction to thereby retract the cable and, in turn, move the carriage toward the first end of the pole, extend the umbrella frame into an open condition and bring the endcap means into engagement with the carriage, and (ii) rotatable in a second direction to release the cable and in turn collapse the umbrella frame into a closed condition, and release the endcap means from engagement with the carriage and move the carriage toward the second end of the pole.

21. An umbrella assembly as recited in claim 20, wherein the endcap means are teeth.

22. An umbrella assembly as recited in claim 21, further comprising teeth on the carriage for engaging the endcap teeth.

23. An umbrella assembly with an adjustable umbrella frame, comprising:

a base;

a pole mounted on the base;

an adapter having a ball first mounted on the pole and a socket selectively coupled to the first portion, wherein the ball and socket have raised and depressed surfaces;

an umbrella frame mounted to the second portion of the adapter;

a handle rotatably mounted on the pole; and a cable coupled at one end to the handle and coupled at another end to the umbrella frame; and wherein the handle is (i) rotatable in a first direction to thereby retract the cable and, in turn, extend the umbrella frame into an open condition and bring the second portion into fixed engagement with the first portion of the adapter, and (ii) rotatable in a second direction to release the cable and, in turn, collapse the umbrella frame into a closed condition, and release the second portion from fixed engagement with the first portion of the adapter.

24. An umbrella assembly as recited in claim 23, further comprising an endcap mounted in a first end of the pole opposite to a second end of the pole mounted on the base, the endcap having means for selectively engaging the adapter for preventing relative rotation of the umbrella frame.

25. An umbrella assembly comprising:

a base;

a pole mounted on the base including a lower portion extending from the base, and an upper portion connected to the lower portion;

a carriage slidably mounted on the pole;

an umbrella frame including an adapter coupled to the carriage;

a handle rotatably mounted on the pole; and a cable coupled at one end to the handle and coupled at another end to the umbrella frame; and an endcap mounted in a first end of the pole opposite to a second end of the pole mounted on the base, wherein the endcap is larger in diameter than the pole to thereby prevent the carriage from moving off the first end of the pole, said endcap having means for selectively engaging the carriage and wherein the handle is (i) rotatable in a first direction to thereby retract the cable and in turn move the carriage to a preselected location on the upper portion of the pole and, in turn, extend the umbrella frame into an open condition, and (ii) rotatable in a second direction to release the cable and in turn collapse the umbrella frame into a closed condition, and to slidably move the carriage along the upper portion of the pole toward the lower portion of the pole.

* * * * *